US005551126A

United States Patent [19]

Wallo

[11] Patent Number: 5,551,126

[45] Date of Patent: Sep. 3, 1996

[54] BUTTON-ON HOLDER FOR EYEGLASSES

[76] Inventor: William H. Wallo, 8 Leeward Island, Clearwater, Fla. 34630

[21] Appl. No.: 406,158

[22] Filed: Mar. 17, 1995

[51] Int. Cl.[6] ..... A44B 21/00; A45C 11/00

[52] U.S. Cl. ..... 24/3.3; 351/155; 24/66.2; 24/56; 24/570

[58] Field of Search ..... 24/3.3, 3.05 S, 24/66.2, 56, 563, 570; 351/155

[56] References Cited

U.S. PATENT DOCUMENTS

| | | | |
|---|---|---|---|
| 1,478,783 | 12/1923 | Ferriday | 24/570 X |
| 1,484,354 | 2/1924 | McLean | 24/56 |
| 1,770,139 | 7/1930 | Keller | 24/56 |
| 1,784,537 | 12/1930 | Rau | 24/56 |
| 2,248,939 | 7/1941 | Benson | 24/56 |
| 5,033,612 | 7/1991 | Bivins | 24/3.3 X |
| 5,129,617 | 7/1992 | MacWilliamson | 24/3.3 X |
| 5,195,218 | 3/1993 | Joseph et al. | 24/30.5 S X |

*Primary Examiner*—Peter M. Cuomo
*Assistant Examiner*—Robert J. Sandy
*Attorney, Agent, or Firm*—David Kiewit

[57] ABSTRACT

An unobtrusive eyeglass hanger attached by a button to the front of a shirt or blouse comprises a thin sheet of flexible material with a specially shaped throughhole having a large temple-retaining portion near the lower end of the hanger and a smaller thread-retaining portion near the top. The hanger is donned by inserting a shirt button through the temple-retaining portion of the hole and forcing the threads holding the button to the shirt through a narrow locking slot between the temple-retaining and thread-retaining portions. One of the temples of a pair of spectacles that are not being worn is inserted through the temple-retaining portion. The hanger holds the eyeglasses in a way that permits the wearer to bend forward at the waist without fear of dropping them onto the ground. Various messages, logos and the like may be printed on a top portion of the hanger, and the hanger then distributed as an advertising specialty item.

4 Claims, 2 Drawing Sheets

BUTTON-ON HOLDER FOR EYEGLASSES

BACKGROUND OF THE INVENTION

Sunglasses that are not being worn on the user's face are often suspended from the front of an article of apparel (e.g., by inserting a temple of the sunglasses into the neckline of the garment). Moreover, many men habitually place eyeglasses loosely in the breast pocket of a shirt. These suspended or loosely emplaced eyeglasses commonly fall to the ground when the wearer bends forward at the waist.

It is well known to protect eyeglasses that are only worn part-time by attaching the ends of a flexible band to both temples and using the band to suspend the spectacles from the wearer's neck. Protective cases that clip into the pockets of shirts that have pockets are also well known. Both of these approaches to protecting eyeglasses have drawbacks. Some people do not like feeling a band flopping about on the back of the neck. Eyeglass cases can be forgotten, and usually require the user to either wear a shirt with a pocket or to carry a purse.

SUMMARY OF THE INVENTION

The invention provides an unobtrusive eyeglass hanger that attaches to a button on the front of a shirt or blouse. The hanger of the invention provides a convenient means of holding a pair of spectacles that are not being worn and that holds them in a way that permits the wearer to bend forward at the waist without fear of dropping the part-time worn eyeglasses onto the ground.

It is an object of the invention to provide a hanger having a locking slot securing it about the threads that hold a button onto a shirt, blouse, or other item of upper body apparel.

It is an additional object of the invention to provide an eyeglass hanger having a vee-shaped hole or centering angle that aids in holding a temple of a pair of eyeglasses in a fixed position as the wearer walks about.

It is yet a further object of the invention to provide an advertising specialty item that may be economically imprinted with a graphic, logo, product name, or other like mark and distributed to be worn in public on the front of a wearer's shirt or blouse.

DETAILED DESCRIPTION

Figure 1:
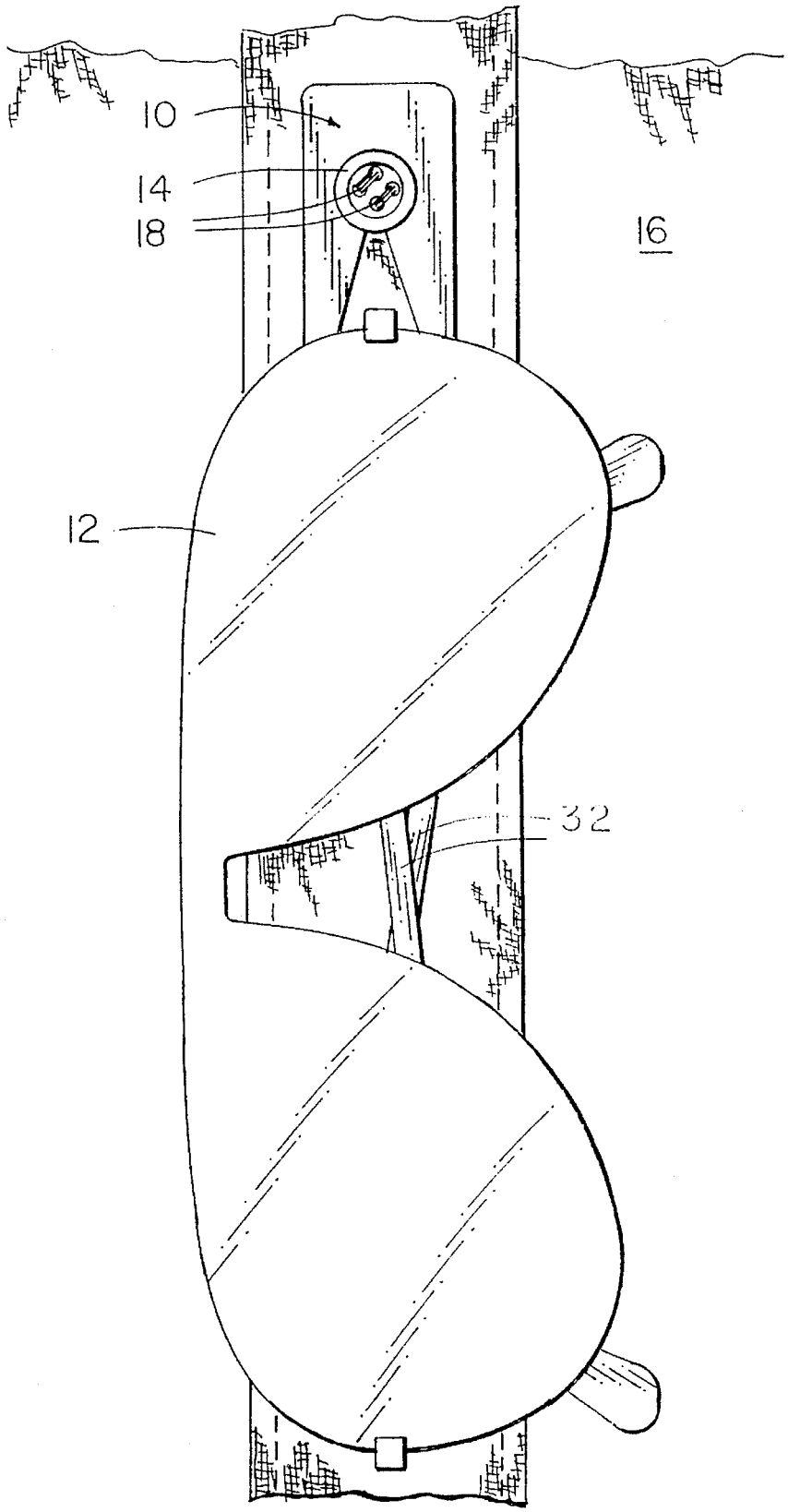
FIG. 1 of the drawing is a front elevational view of the hanger of the invention suspending a pair of sunglasses from the front of a buttoned shirt.

A hanger 10 is shown in FIG. 1 suspending a pair of eyeglasses 12 from a button 14 sewn to the front of a shirt or blouse 16 in a conventional manner with a bundle of thread loops 18. The hanger 10 is made of a thin sheet of flexible material 11 having a throughhole 20 with a thread-retaining portion 22, a locking slot and a temple-retaining portion 26 that preferably has a centering angle 28 at its bottom end.

Figure 4:
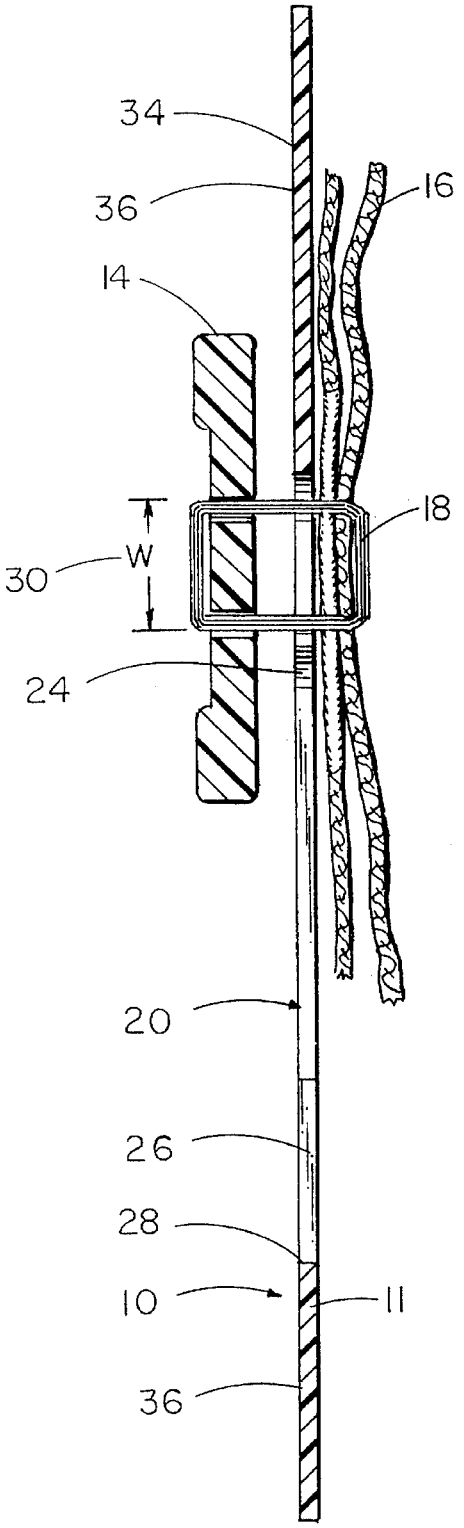
FIG. 4 of the drawing is a side cross-sectional view of the hanger taken along the line 4—4 of FIG. 2.

The temple-retaining portion 22 of the throughhole 20 is wide enough that any size of shirt button 14 can be inserted through it, the hanger 10 then pulled downward so that the thread loops 18 pass through the locking slot 24 into the thread-retaining portion 22 of the throughhole 20. Once the hanger 10 is donned in such a fashion, it may be worn comfortably on the front of a wearer's shirt or blouse 16. In the preferred embodiment, the thread-retaining portion 22 of the throughhole 20 has a diameter greater than a threading-hole spacing 30 (indicated with the letter W in FIG. 4 of the drawing) of a button 14, but smaller than the outer diameter of a button 14. Thus, the hanger 10 is securely retained behind the button 14 but can rotate relatively freely about the thread loops 18. Additionally, the minimum width of the locking slot 24 is preferably chosen to be less than the threading-hole spacing 30 so that the bundle of thread loops 18 holding the button 14 to the shirt or blouse 16 is compressed in passing through the slot 24.

Once a user has put the hanger 10 onto the front of a shirt or blouse 16, he or she may then insert one of the temples 32 of a pair of eyeglasses 12 through the temple-retaining portion 26 of the hole 20, which is preferably wide enough to accommodate oversize ear-pieces (which may be 16 mm across) in order to suspend the eyeglasses 12 from the hanger 10. The provision of a vee-shaped centering angle 28 at the bottom of the throughhole 20 in a preferred embodiment of the hanger 10 aids in centering the temple 32 in the hanger 10 and holding it in a relatively fixed position. This reduces annoying to and fro motion of the eyeglasses 12 as the wearer walks about.

A preferred embodiment of the hanger 10 is made from a flexible plastic sheet that is less than 0.5 mm thick (e.g., 0.015" thick polycarbonate sheet). When the wearer of such a hanger 10 bends forward at the waist, the hanger 10 flexes and allows the bottom of the temple-retaining portion 22 to move relatively away from the shirt front 16, ensuring that the eyeglasses 12 continue to be securely retained in a vertical orientation by the hanger 10. If a rigid hanger 10 were retained against the wearer's chest, when the wearer bent over at the waist a retained pair of eyeglasses could slide out of the hanger, just as eyeglasses are known to slide free of a shirt when hung from the neck thereof. It will be understood that a further advantage of the choice of a thin, flexible sheet for the hanger 10 of the invention is that the bundle of thread loops 18 may deform the material in the region of the locking slot 20, thus aiding passage of the thread loops 18 through the locking slot 18 when the hanger 10 is donned.

In a preferred embodiment, the hanger 10 is made of a transparent plastic material to provide a particularly unobtrusive means of retaining eyeglasses 12. A thin, flexible, transparent plastic sheet may be nearly invisible and is seldom noticed by passersby when worn on the front of a shirt 16.

Figure 3:
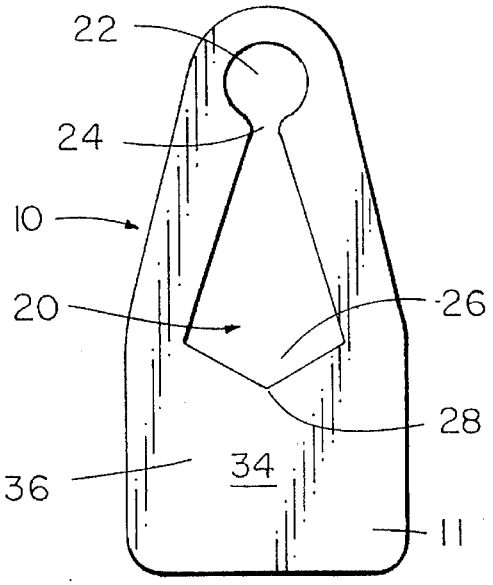
FIG. 3 of the drawing is a front elevational view of an alternate embodiment of the hanger of the invention.
Figure 2:
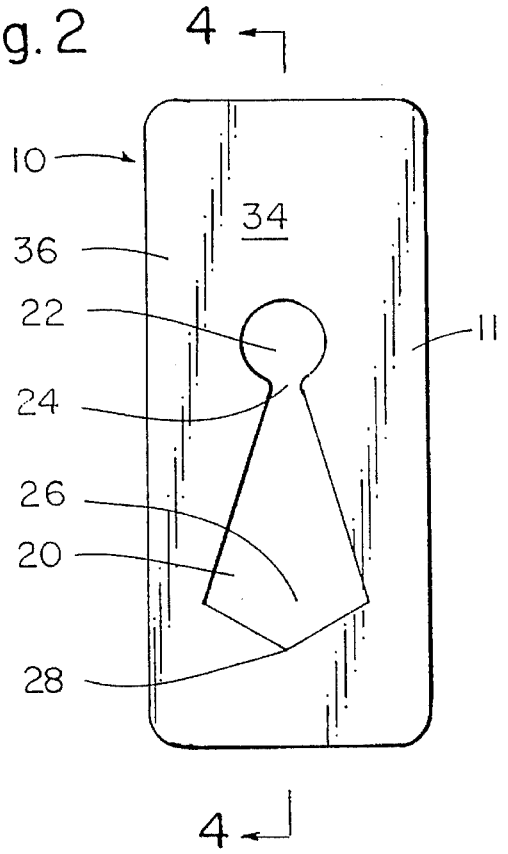
FIG. 2 of the drawing is a front elevational view of a preferred embodiment of the invention.

In an alternate preferred embodiment, an imprint area 34 is provided on the front surface 36 of the hanger 10 for the purpose of imprinting a graphic, logo, slogan, or other indicia as may be used in advertising. The imprint area 34 may be either above (as shown in FIG. 2) or below (as shown in FIG. 3) the throughhole 20. In a preferred embodiment the imprint area 34 is above the throughhole so that it is visible whenever the hanger 10 is worn, rather than being partially or entirely hidden by a pair of eyeglasses 12, as is the case if the imprint area 34 is below the throughhole 20. In this advertising-specialty embodiment, the hanger 10 may be made from brightly colored thin flexible plastic stock so as to attract the attention of people in the vicinity of the wearer of the hanger 10.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is desired to be secured by Letters Patent is:

I claim:

1. A hanger for suspending a pair of eyeglasses from a button sewn onto the front of an article of upper body apparel, the hanger comprising a thin flexible sheet of material having an elongated throughhole therethrough, the throughhole comprising a thread-retaining portion adjacent an upper end thereof, the thread-retaining portion having a diameter greater than a threading-hole spacing of the button, a temple-retaining portion adjacent a lower end thereof, the temple-retaining portion wider than a temple of the pair of eyeglasses, the temple-retaining portion comprising a centering-angle adjacent the lower end, and a locking slot intermediate the thread-retaining portion and the temple-retaining portion, the locking slot narrower than the threading-hole spacing.

2. The hanger of claim 1 wherein a width of the locking slot is less than 3 mm.

3. The hanger of claim 1 wherein the sheet of material comprises a plastic material having a thickness less than 0.5 mm.

4. The hanger of claim 1 wherein the sheet of material comprises a transparent plastic material.

* * * * *